US007699720B2

(12) United States Patent
Sullivan et al.

(10) Patent No.: US 7,699,720 B2
(45) Date of Patent: Apr. 20, 2010

(54) THICK INNER COVER MULTI-LAYER GOLF BALL

(75) Inventors: Michael J. Sullivan, Barrington, RI (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/102,092

(22) Filed: Apr. 14, 2008

(65) Prior Publication Data

US 2008/0188323 A1 Aug. 7, 2008

Related U.S. Application Data

(63) Continuation of application No. 11/469,059, filed on Aug. 31, 2006, now Pat. No. 7,357,734, which is a continuation of application No. 11/267,487, filed on Nov. 4, 2005, now Pat. No. 7,150,687, which is a continuation of application No. 10/841,031, filed on May 7, 2004, now Pat. No. 7,004,856.

(51) Int. Cl.
*A63B 37/06* (2006.01)

(52) U.S. Cl. ..... 473/373

(58) Field of Classification Search ..... 473/373, 473/374, 367, 368

See application file for complete search history.

(56) References Cited

U.S. PATENT DOCUMENTS

| | | | | |
|---|---|---|---|---|
| 3,262,272 | A | 7/1966 | Barakauskas et al. | |
| 4,431,193 | A | 2/1984 | Nesbitt | |
| 5,028,674 | A | 7/1991 | Hatch et al. | |
| 5,306,760 | A | 4/1994 | Sullivan | |
| 5,368,304 | A | 11/1994 | Sullivan et al. | |
| 5,484,870 | A * | 1/1996 | Wu | 528/28 |
| 5,688,191 | A | 11/1997 | Cavallaro et al. | |
| 5,692,974 | A | 12/1997 | Wu et al. | |
| 5,779,561 | A | 7/1998 | Sullivan et al. | |
| 5,803,831 | A | 9/1998 | Sullivan et al. | |
| 5,885,172 | A | 3/1999 | Hebert et al. | |
| 5,902,855 | A | 5/1999 | Sullivan | |
| 5,919,100 | A | 7/1999 | Boehm et al. | |
| 5,984,806 | A | 11/1999 | Sullivan et al. | |
| 6,015,356 | A | 1/2000 | Sullivan et al. | |
| 6,083,119 | A | 7/2000 | Sullivan et al. | |
| 6,117,024 | A | 9/2000 | Dewanjee | |
| 6,126,559 | A | 10/2000 | Sullivan et al. | |
| 6,132,324 | A | 10/2000 | Hebert et al. | |
| 6,142,887 | A | 11/2000 | Sullivan et al. | |
| 6,152,834 | A | 11/2000 | Sullivan | |
| 6,187,864 | B1 | 2/2001 | Rajagopalan | |
| 6,220,972 | B1 | 4/2001 | Sullivan et al. | |
| 6,232,400 | B1 | 5/2001 | Harris et al. | |
| 6,244,977 | B1 | 6/2001 | Sullivan et al. | |
| 6,245,862 | B1 | 6/2001 | Rajagopalan | |
| 6,287,217 | B1 | 9/2001 | Sullivan et al. | |
| 6,290,611 | B1 | 9/2001 | Rajagopalan et al. | |
| 6,309,314 | B1 | 10/2001 | Sullivan et al. | |
| 6,355,715 | B1 | 3/2002 | Ladd et al. | |
| 6,419,535 | B1 | 7/2002 | Herrera | |
| 6,435,987 | B1 | 8/2002 | Dewanjee | |
| 6,443,858 | B2 | 9/2002 | Bartels et al. | |
| 6,478,697 | B2 | 11/2002 | Yagley et al. | |
| 6,508,968 | B1 | 1/2003 | Bulpett et al. | |
| 6,602,941 | B2 | 8/2003 | Higuchi et al. | |
| 6,653,382 | B1 | 11/2003 | Statz et al. | |
| 6,667,001 | B2 * | 12/2003 | Sullivan et al. | 264/129 |
| 6,756,436 | B2 | 6/2004 | Rajagopalan et al. | |
| 6,953,820 | B2 | 10/2005 | Statz et al. | |
| 6,966,850 | B2 | 11/2005 | Watanabe et al. | |
| 7,357,734 | B2 * | 4/2008 | Sullivan et al. | 473/374 |
| 2001/0055998 | A1 | 12/2001 | Watanabe | |
| 2002/0002087 | A1 | 1/2002 | Watanabe | |
| 2002/0019270 | A1 | 2/2002 | Watanabe | |
| 2002/0045498 | A1 | 4/2002 | Watanabe et al. | |
| 2003/0050373 | A1 | 3/2003 | Chen | |
| 2003/0114565 | A1 | 6/2003 | Chen et al. | |

* cited by examiner

*Primary Examiner*—Raeann Trimiew
(74) *Attorney, Agent, or Firm*—William B. Lacy

(57) ABSTRACT

A golf ball including a core having a compression of about 50 or less and a COR of 0.800 or greater, a thermoset polyurea cover having a hardness of 64 Shore D or less and a thickness of 0.02 inches to 0.1 inches, and an intermediate layer disposed between the core and the cover, the intermediate layer having a thickness of 0.110 inches or greater and comprising a partially- or fully-neutralized ionomer. A combination of the core and the intermediate layer has a compression of 60 or greater and the golf ball has a COR of 0.805 or greater when measured at an incoming velocity of 125 ft/s and greater than 0.75 when measured at an incoming velocity of 160 ft/s.

20 Claims, No Drawings

THICK INNER COVER MULTI-LAYER GOLF BALL

CROSS-REFERENCE TO RELATED APPLICATIONS

This application is a continuation of U.S. patent application Ser. No. 11/469,059, filed Aug. 31, 2006 and now U.S. Pat. No. 7,357,734, which is a continuation of U.S. patent application Ser. No. 11/267,487, filed Nov. 4, 2005 and now U.S. Pat. No. 7,150,687, which is a continuation of U.S. patent application Ser. No. 10/841,031, filed May 7, 2004 and now U.S. Pat. No. 7,004,856.

FIELD OF THE INVENTION

This invention generally relates to golf balls with high coefficient of restitution and low deformation, and more particularly to also a high coefficient of restitution golf ball at high club speeds.

BACKGROUND OF THE INVENTION

Golf balls have been designed to provide particular playing characteristics. These characteristics generally include initial ball velocity, coefficient of restitution (COR), compression, weight distribution and spin of the golf ball, which can be optimized for various types of players.

Golf balls can generally be divided into two classes: solid and wound. Solid golf balls include single-layer, dual-layer (i.e., solid core and a cover), and multi-layer (i.e., solid core of one or more layers and/or a cover of one or more layers) golf balls. Wound golf balls typically include a solid, hollow, or fluid-filled center, surrounded by tensioned elastomeric thread, and a cover.

Generally, the hardness of a golf ball or a golf ball core is one among other factors used in designing golf balls. Typically, when a ball is hard, e.g., possessing high compression values and low deformation when struck by a club, it typically has high COR and high initial velocity after impact with a golf club. However, hard ball has a "hard" feel and is difficult to control around the greens. A softer ball, e.g., lower compression value and high deformation, has a "soft" feel and is easier to control with short iron clubs for greenside play. Recently developed solid balls have a core, at least one intermediate layer, and a cover. The intermediate layer improves other playing characteristics of solid balls, and can be made from thermoset or thermoplastic materials.

Recent advancements in golf ball design can produce golf balls with low compression for soft "feel" and high COR for long flight distance. The COR for low compression balls, however, decreases at higher impact speed with golf clubs.

Hence, there remains a need in the art for low compression golf balls that have high coefficient of restitution at low impact speeds and at high impact speeds.

SUMMARY OF THE INVENTION

The present invention is directed to a golf ball comprising a core comprising a halogenated thiophenol and having a diameter of from about 1.3 inches to about 1.4 inches, a compression of about 44 or less; and a coefficient of restitution of from about 0.770 to about 0.810; a cast polyurethane or polyurea cover; and an intermediate layer disposed between the core and the cover, the intermediate layer having a thickness of from about 0.11 inches to about 0.12 inches and being formed from a composition comprising at least two ionomers; wherein a combination of the core and the intermediate layer results in a compression of from about 70 to about 100, and the golf ball has a coefficient of restitution of from about 0.805 to about 0.820 at about 125 ft/s and a compression of from about 75 to about 105.

The core typically has a diameter of from about 1.380 inches to about 1.387 inches and/or a coefficient of restitution of from about 0.774 to about 0.805. The intermediate layer thickness may also be from about 0.115 inches to about 0.119 inches, and the intermediate layer hardness may be from about 55 Shore D to about 70 Shore D. In one embodiment, the combination of the intermediate layer and the core has a coefficient of restitution of from about 0.810 to about 0.820. In another embodiment, the combination of the intermediate layer and the core has a compression of from about 72 to about 90.

The cover may be a castable polyurethane or polyurea material, and preferably has a hardness of from about 40 Shore D to about 60 Shore D. The halogenated thiophenol in the core is typically present in an amount of from about 0.01 pph to about 5 pph. The at least two ionomers are partially- or fully- (10-100%) neutralized by a metal cation, such as Na; Zn; Mg; Li; Ca; Ba; Pb; Al; and K metal cations.

The present invention is further directed to a golf ball comprising a core comprising a halogenated thiophenol, and having a diameter of about 1.4 inches or less, a compression of about 70 or less; and a coefficient of restitution of from about 0.770 to about 0.810; a cover; and an intermediate layer disposed between the core and the cover, the intermediate layer having a thickness of from about 0.1 inches to about 0.5 inches and being formed from a composition comprising at least two ionomers; wherein a combination of the core and the intermediate layer results in a compression of about 60 or greater, and the golf ball has a coefficient of restitution of about 0.800 or greater at about 125 ft/s and a compression of from about 85 to about 105.

The cover may include partially- or fully-neutralized ionomers, metallocene-catalyzed polymers, single-site catalyzed polymers, polyesters, polyethers, balata, crosslinked diene rubbers, styrene block copolymers, polyurethanes, polyureas, polyurethane-ureas, polyurea-urethanes, or non-ionic fluoropolymers.

The intermediate layer preferably has a flexural modulus of about 50,000 psi or greater and/or a hardness of about 55 Shore D or greater. The core diameter is preferably from about 1.375 inches to about 1.40 inches. The at least two ionomers are typically neutralized by a metal cation, such as Na; Zn; Mg; Li; Ca; Ba; Pb; Al; and K metal cations.

The present invention is also directed to a golf ball comprising a core having a compression of about 50 or less and a coefficient of restitution of about 0.800 or greater; a cover; and an intermediate layer disposed between the core and the cover, the intermediate layer having a thickness of about 0.110 inches or greater; wherein a combination of the core and the intermediate layer results in a compression of about 60 or greater and a coefficient of restitution of about 0.805 or greater at about 125 ft/s.

The core preferably has a diameter of from about 0.5 inches to about 1.4 inches and a compression of about 45 or less; and the intermediate layer has a flexural modulus of from about 50,000 psi to about 150,000 psi and a thickness of about 0.12 inches or greater.

The cover may include a thermoset polymer having a hardness of about 64 Shore D or less and has a thickness of from about 0.02 inches to about 0.1 inches. The core can have a diameter of about 0.8 inches to about 1.4 inches. In one embodiment, the core includes a center and at least one outer core layer and/or the intermediate layer includes two or more layers. Preferably, the core includes a halogenated thiophenol. The at least two ionomers are generally neutralized by a metal cation, such as Na; Zn; Mg; Li; Ca; Ba; Pb; Al; and K metal cations.

The present invention is also directed to a golf ball comprising a core having a diameter of 0.5 inches to 1.4 inches, a compression of about 45 or less, and a COR of 0.770 to 0.810; a cast polyurea cover; and an intermediate layer disposed between the core and the cover, the intermediate layer having a thickness of 0.11 inches or greater and being formed from a composition comprising a highly-neutralized thermoplastic material comprising an ethylene, α,β-ethylenically unsaturated $C_{3-8}$ carboxylic acid copolymer(s), a fatty acid salt, and a sufficient amount of a cation source to increase the level of neutralization of all the acid moieties to 100%, wherein a combination of the core and the intermediate layer results in a compression of 70 to about 100, and the golf ball has a COR of 0.805 to 0.820 when measured at an incoming velocity of 125 ft/s and greater than 0.75 when measured at an incoming velocity of 160 ft/s, and a compression of from 75 to 105.

The core typically has a diameter of 0.8 inches to 1.4 inches and the intermediate layer should have a flexural modulus of from 50,000 psi to 150,000 psi and a thickness of 0.12 inches or greater. Preferably, the core has a diameter of 1.3 inches to about 1.4 inches. The golf ball may further include an inner cover layer located between the cover layer and the intermediate layer. The intermediate layer thickness is typically 0.115 inches to 0.119 inches and has a hardness of 55 Shore D to 70 Shore D.

A sphere resulting from a combination of the intermediate layer and the core generally has a COR of 0.810 to 0.820 when measured at an incoming velocity of 125 ft/s and a compression of 72 to 90.

The thermoset polyurea cover has a hardness of 40 Shore D to 60 Shore D. In one embodiment, the core comprises a halogenated thiophenol. Preferably, the halogenated thiophenol is present in an amount of 0.01 pph to 5 pph, more preferably 2.2 pph to 4 pph.

The present invention is further directed to a golf ball comprising a core having a compression of about 50 or less and a COR of 0.800 or greater; a thermoset polyurea cover having a hardness of 64 Shore D or less and a thickness of 0.02 inches to 0.1 inches; and an intermediate layer disposed between the core and the cover, the intermediate layer having a thickness of about 0.110 inches or greater; wherein at least one of the core or intermediate layer comprise a composition comprising a highly-neutralized thermoplastic material comprising an ethylene, α,β-ethylenically unsaturated $C_{3-8}$ carboxylic acid copolymer(s), a fatty acid salt, and a sufficient amount of a cation source to increase the level of neutralization of all the acid moieties to 100%; and wherein a combination of the core and the intermediate layer results in a compression of about 60 or greater and the golf ball has a COR of 0.805 or greater when measured at an incoming velocity of 125 ft/s and greater than 0.75 when measured at an incoming velocity of 160 ft/s.

In one embodiment the core has a diameter of 0.5 inches to 1.4 inches and, more preferably, 0.8 inches to 1.3 inches. The golf ball may further include an inner cover layer located between the cover layer and the intermediate layer. The intermediate layer generally has a hardness of 55 Shore D to 70 Shore D whereas the thermoset polyurea cover typically has a hardness of 40 Shore D to 60 Shore D. A sphere resulting from a combination of the intermediate layer and the core has a compression of 70 to 100.

DEFINITIONS

The following terms that are used in this application are defined in terms of the enumerated ASTM tests: Specific Gravity ASTM D-792, Flexural Modulus ASTM D-790, Shore D Hardness ASTM D-2240, and Shore C Hardness ASTM D-2240. The ASTM D-792 test was carried out in lab conditions where the temperature was controlled to 20-23° C.

As used herein, the terms "points" and "compression points" refer to the compression scale or the compression scale based on the ATTI Engineering Compression Tester. This scale, which is well known to those working in this field, is used in determining the relative compression of a core or ball. Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inches (5 mm) against this spring. If the spring, in turn, compresses 0.2 inches, the compression is rated at 100; if the spring compresses 0.1 inches, the compression value is rated as 0. Thus more compressible, softer materials will have lower Atti gauge values than harder, less compressible materials. Compression measured with this instrument is also referred to as PGA compression.

As used herein, "COR" refers to Coefficient of Restitution, which is obtained by dividing a ball's rebound velocity by its initial (i.e., incoming) velocity. This test is performed by firing the samples out of an air cannon at a vertical steel plate over a range of test velocities (from 75 to 150 ft/s). A golf ball having a high COR dissipates a smaller fraction of its total energy when colliding with the plate and rebounding therefrom than does a ball with a lower COR. Unless otherwise noted, the COR values reported herein are the values determined at an incoming velocity of 125 ft/s.

As used herein, the term "copolymer" refers to a polymer which is formed from two or more monomers, wherein the monomers are not identical.

As used herein, the term "terpolymer" refers to a polymer which is formed from three monomers, wherein the monomers are not identical.

As used herein, the term "fillers" includes any compound or composition that can be used to vary the density and other properties of the subject golf ball cores.

As used herein, the term "pph" in connection with a batch formulation refers parts by weight of the constituent per hundred parts of the base composition (e.g., elastomer).

As used herein, the term "Mooney viscosity" refers to the unit used to measure the plasticity of raw or unvulcanized rubber. The plasticity in a Mooney unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

The term "about," as used herein in connection with one or more numbers or numerical ranges, should be understood to refer to all such numbers, including all numbers in a range.

DETAILED DESCRIPTION OF THE PREFERRED EMBODIMENTS

The golf balls of the present invention may comprise any of a variety of constructions, such as a two-piece, three-piece, multi-layer, or wound ball having a variety of cores, intermediate layers, covers, and coatings. The covers and cores of the present invention include structures comprising one or more layers. Cores may include a single, unitary layer, comprising the entire core from the center of the core to its outer periphery, or may contain a center surrounded by at least one outer core layer. The center, the innermost portion of the core, is preferably solid, but may be hollow or liquid-, gel-, or gas-filled. The outer core layer may also be a wound layer formed of a tensioned elastomeric material. Cover layers of the present invention may also contain one or more layers, such as a double cover comprising an inner and outer cover layer. Optionally, an intermediate layer disposed between the core and cover may be incorporated. The intermediate layer, if present, may comprise one or more layers, and are sometimes referred to in the art, and, thus, herein as well, as inner cover layers, outer core layers, or mantle layers.

In accordance to the present invention, a golf ball is provided with a low compression and high COR layer, which is supported or otherwise reinforced by a low deformation layer. Preferably, the low compression, high COR layer is made from a polymer composition including a halogenated thiophenol compound. Such rubber and halogenated thiophenol composition is fully disclosed in U.S. Pat. No. 6,635,716, the disclosure of which is hereby incorporated by reference in its entirety.

The preferred polymeric composition comprises a base rubber compound, a co-reaction agent, a filler, a halogenated thiophenol compound and a co-crosslinking or initiator agent. The base rubber compound typically includes natural or synthetic rubbers. A preferred base rubber is 1,4-polybutadiene having a cis-structure of at least 40%, more preferably at least about 90%, and most preferably at least about 95%. Most preferably, the base rubber comprises high-Mooney-viscosity rubber. Preferably, the base rubber has a Mooney viscosity greater than about 35, more preferably greater than about 50. Preferably, the polybutadiene rubber has a molecular weight greater than about 400,000 and a polydispersity of no greater than about 2. A common indicator of the degree of molecular weight distribution of a polymer is its polydispersity, defined as the ratio of weight average molecular weight, $M_w$, to number average molecular weight, $M_n$. Polydispersity ("dispersity") also provides an indication of the extent to which the polymer chains share the same degree of polymerization. If the polydispersity is 1.0, then all polymer chains must have the same degree of polymerization. Since $M_w$ is always equal to or greater than $M_n$, polydispersity, by definition, is equal to or greater than 1.0. Such rubber compounds are commercially available from Bayer of Akron, Ohio, UBE Industries of Tokyo, Japan, and Shell of Houston, Tex., among others. The base rubber may also be mixed with other elastomers known in the art such as natural rubber, polyisoprene rubber and/or styrene-butadiene rubber in order to modify the properties of the core.

Suitable co-reaction agents include a metal salt of diacrylate, dimethacrylate or monomethacrylate. Preferably, the co-reaction agent is zinc diacrylate (ZDA) and is present in the amount from about 5 to about 40 and more preferably from about 5 to about 30 and most preferably from about 10 to about 20 parts per one-hundred parts of rubber compound (phr). Suitable cross-linking agents include any known polymerization initiator, which decomposes during the cure cycle. Such initiators include, but are not limited to, organic peroxide compounds such as dicumyl peroxide. In its pure form, the preferred amount of peroxide is between about 0.25 phr and about 2.5 phr. Any filler can be used in any desired quantity to alter a property of the core, including specific weight, flexural modulus, moment of inertia, rheological properties, among others. Suitable fillers include, but are not limited to, tungsten, zinc oxide, barium sulfate, silica, metal oxides, ceramic and fibers.

Preferably, polybutadiene rubber compositions of the present invention contain halogenated thiophenol compound, more preferably about 0.01 pph to about 5 pph, and most preferably between about 2.2 pph and about 4 pph. The halogenated thiophenol compound may include pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; and their zinc salts, the metal salts thereof, and mixtures thereof. Preferably, the preferred halogenated thiophenol is pentachlorothiophenol or a metal salt thereof. The metal salt may be zinc, calcium, potassium, magnesium, sodium, and lithium, but is preferably zinc. Pentachlorothiophenol is commercially available from Strucktol Company of Stow, Ohio, and zinc pentachlorothiophenol is commercially available from eChinachem of San Francisco, Calif.

This preferred polybutadiene rubber composition may further include an α,β-unsaturated carboxylic acid or a metal salt thereof, an organic peroxide, and a filler. Also, as discussed in co-pending '448 patent application, another preferred polybutadiene rubber compound comprising the halogenated thiophenol compound is a mid Mooney viscosity polybutadiene having viscosity in the range of about 40 Mooney to about 60 Mooney.

U.S. application Ser. No. 10/230,015, now U.S. Publication No. 2003/0114565, and U.S. application Ser. No. 10/108,793, now U.S. Publication No. 2003/0050373, which are incorporated by reference herein in their entirety, discuss soft, highly resilient ionomers, which are preferably from neutralizing the acid copolymer(s) of at least one E/X/Y copolymer, where E is ethylene, X is the α,β-ethylenically unsaturated carboxylic acid, and Y is a softening co-monomer. X is preferably present in 2-30 (preferably 4-20, most preferably 5-15) wt. % of the polymer, and Y is preferably present in 17-40 (preferably 20-40, and more preferably 24-35) wt. % of the polymer. Preferably, the melt index (MI) of the base resin is at least 20, or at least 40, more preferably, at least 75 and most preferably at least 150. Particular soft, resilient ionomers included in this invention are partially neutralized ethylene/(meth) acrylic acid/butyl (meth)acrylate copolymers having an MI and level of neutralization that results in a melt processible polymer that has useful physical properties. The copolymers are at least partially neutralized. Preferably at least 40, or, more preferably at least 55, even more preferably about 70, and most preferably about 80 of the acid moiety of the acid copolymer is neutralized by one or more alkali metal, transition metal, or alkaline earth metal cations. Cations useful in making the ionomers of this invention comprise lithium, sodium, potassium, magnesium, calcium, barium, or zinc, or a combination of such cations.

The invention also relates to a "modified" soft, resilient thermoplastic ionomer that comprises a melt blend of (a) the acid copolymers or the melt processible ionomers made therefrom as described above and (b) one or more organic acid(s) or salt(s) thereof, wherein greater than 80%, preferably greater than 90% of all the acid of (a) and of (b) is neutralized. Preferably, 100% of all the acid of (a) and (b) is neutralized by a cation source. Preferably, an amount of cation source in excess of the amount required to neutralize 100% of the acid in (a) and (b) is used to neutralize the acid in (a) and (b). Blends with fatty acids or fatty acid salts are preferred.

The organic acids or salts thereof are added in an amount sufficient to enhance the resilience of the copolymer. Preferably, the organic acids or salts thereof are added in an amount sufficient to substantially remove remaining ethylene crystallinity of the copolymer.

Preferably, the organic acids or salts are added in an amount of at least about 5% (weight basis) of the total amount of copolymer and organic acid(s). More preferably, the organic acids or salts thereof are added in an amount of at least about 15%, even more preferably at least about 20%. Preferably, the organic acid(s) are added in an amount up to about 50% (weight basis) based on the total amount of copolymer and organic acid. More preferably, the organic acids or salts thereof are added in an amount of up to about 40%, more preferably, up to about 35%. The non-volatile, non-migratory organic acids preferably are one or more aliphatic, mono-functional organic acids or salts thereof as described below, particularly one or more aliphatic, mono-functional, saturated or unsaturated organic acids having less than 36 carbon atoms or salts of the organic acids, preferably stearic acid or oleic acid. Fatty acids or fatty acid salts are most preferred.

Processes for fatty acid (salt) modifications are known in the art. Particularly, the modified highly-neutralized soft, resilient acid copolymer ionomers of this invention can be produced by:

(a) melt-blending (1) ethylene, α,β-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory organic acids to substantially enhance the resilience and to disrupt (preferably remove) the remaining ethylene crystallinity, and then concurrently or subsequently (b) Adding a sufficient amount of a cation source to increase the level of neutralization of all the acid moieties (including those in the acid copolymer and in the organic acid if the non-volatile, non-migratory organic acid is an organic acid) to the desired level.

The weight ratio of X to Y in the composition is at least about 1:20. Preferably, the weight ratio of X to Y is at least about 1:15, more preferably, at least about 1:10. Furthermore, the weight ratio of X to Y is up to about 1:1.67, more preferably up to about 1:2. Most preferably, the weight ratio of X to Y in the composition is up to about 1:2.2.

The acid copolymers used in the present invention to make the ionomers are preferably 'direct' acid copolymers (containing high levels of softening monomers). As noted above, the copolymers are at least partially neutralized, preferably at least about 40% of X in the composition is neutralized. More preferably, at least about 55% of X is neutralized. Even more preferably, at least about 70, and most preferably, at least about 80% of X is neutralized. In the event that the copolymer is highly neutralized (e.g., to at least 45%, preferably 50%, 55%, 70%, or 80%, of acid moiety), the MI of the acid copolymer should be sufficiently high so that the resulting neutralized resin has a measurable MI in accord with ASTM D-1238, condition E, at 190° C., using a 2160 gram weight. Preferably this resulting MI will be at least 0.1, preferably at least 0.5, and more preferably 1.0 or greater. Preferably, for highly neutralized acid copolymer, the MI of the acid copolymer base resin is at least 20, or at least 40, at least 75, and more preferably at least 150.

The acid copolymers preferably comprise alpha olefin, particularly ethylene, $C_{3-8}$ α,β-ethylenically unsaturated carboxylic acid, particularly acrylic and methacrylic acid, and softening monomers, selected from alkyl acrylate, and alkyl methacrylate, wherein the alkyl groups have from 1-8 carbon atoms, copolymers. By "softening," it is meant that the crystallinity is disrupted (the polymer is made less crystalline). While the alpha olefin can be a $C_2$-$C_4$ alpha olefin, ethylene is most preferred for use in the present invention. Accordingly, it is described and illustrated herein in terms of ethylene as the alpha olefin.

The acid copolymers, when the alpha olefin is ethylene, can be described as E/X/Y copolymers where E is ethylene, X is the α,β-ethylenically unsaturated carboxylic acid, and Y is a softening co-monomer X is preferably present in 2-30 (preferably 4-20, most preferably 5-15) wt. % of the polymer, and Y is preferably present in 17-40 (preferably 20-40, most preferably 24-35) wt. % of the polymer.

The ethylene-acid copolymers with high levels of acid (X) are difficult to prepare in continuous polymerizers because of monomer-polymer phase separation. This difficulty can be avoided however by use of "co-solvent technology" as described in U.S. Pat. No. 5,028,674, or by employing somewhat higher pressures than those which copolymers with lower acid can be prepared.

Specific acid-copolymers include ethylene/(meth) acrylic acid/n-butyl (meth)acrylate, ethylene/(meth) acrylic acid/isobutyl (meth)acrylate, ethylene/(meth) acrylic acid/methyl (meth)acrylate, and ethylene/(meth) acrylic acid/ethyl (meth) acrylate terpolymers.

The organic acids employed are aliphatic, mono-functional (saturated, unsaturated, or multi-unsaturated) organic acids, particularly those having fewer than 36 carbon atoms. Also salts of these organic acids may be employed. Fatty acids or fatty acid salts are preferred. The salts may be any of a wide variety, particularly including the barium, lithium, sodium, zinc, bismuth, potassium, strontium, magnesium or calcium salts of the organic acids. Particular organic acids useful in the present invention include caproic acid, caprylic acid, capric acid, lauric acid, stearic acid, behenic acid, erucic acid, oleic acid, and linoleic acid.

The optional filler component is chosen to impart additional density to blends of the previously described components, the selection being dependent upon the different parts (e.g., cover, mantle, core, center, intermediate layers in a multilayered core or ball) and the type of golf ball desired (e.g., one-piece, two-piece, three-piece or multiple-piece ball), as will be more fully detailed below.

Generally, the filler will be inorganic having a density greater than about 4 grams/cubic centimeter (g/cm$^3$), preferably greater than 5 g/cm$^3$, and will be present in amounts between 0 to about 60 wt. % based on the total weight of the composition. Examples of useful fillers include zinc oxide, barium sulfate, lead silicate and tungsten carbide, as well as the other well-known fillers used in golf balls. It is preferred that the filler materials be non-reactive or almost non-reactive and not stiffen or raise the compression nor reduce the coefficient of restitution significantly.

Additional optional additives useful in the practice of the subject invention include acid copolymer wax (e.g., Allied wax AC 143 believed to be an ethylene/16-18% acrylic acid copolymer with a number average molecular weight of 2,040), which assist in preventing reaction between the filler materials (e.g., ZnO) and the acid moiety in the ethylene copolymer. Other optional additives include $TiO_2$, which is used as a whitening agent; optical brighteners; surfactants; processing aids; etc.

Ionomers may be blended with conventional ionomeric copolymers (di-, ter-, etc.), using well-known techniques, to manipulate product properties as desired. The blends would still exhibit lower hardness and higher resilience when compared with blends based on conventional ionomers.

Also, ionomers can be blended with non-ionic thermoplastic resins to manipulate product properties. The non-ionic thermoplastic resins would, by way of non-limiting illustrative examples, include thermoplastic elastomers, such as polyurethane, poly-ether-ester, poly-amide-ether, polyether-urea, PEBAX® (a family of block copolymers based on poly-ether-block-amide, commercially supplied by Atochem), styrene-butadiene-styrene (SBS) block copolymers, styrene (ethylene-butylene)-styrene block copolymers, etc., poly amide (oligomeric and polymeric), polyesters, polyolefins including PE, PP, E/P copolymers, etc., ethylene copolymers with various comonomers, such as vinyl acetate, (meth)acrylates, (meth)acrylic acid, epoxy-functionalized monomer, CO, etc., functionalized polymers with maleic anhydride grafting, epoxidization etc., elastomers, such as EPDM, metallocene catalyzed PE and copolymer, ground up powders of the thermoset elastomers, etc. Such thermoplastic blends comprise about 1% to about 99% by weight of a first thermoplastic and about 99% to about 1% by weight of a second thermoplastic.

Additionally, the compositions of U.S. Pat. Nos. 6,953,820 and 6,653,382, both of which are incorporated herein in their entirety, discuss compositions having high COR when formed into solid spheres.

The thermoplastic composition of this invention comprises a polymer which, when formed into a sphere that is 1.50 to 1.54 inches in diameter, has a coefficient of restitution (COR) when measured by firing the sphere at an initial velocity of 125 ft/s against a steel plate positioned 3 feet from the point where initial velocity and rebound velocity are determined and by dividing the rebound velocity from the plate by the initial velocity and an Atti compression of no more than 100.

The thermoplastic composition of this invention preferably comprises (a) aliphatic, mono-functional organic acid(s) having fewer than 36 carbon atoms; and (b) ethylene, $C_3$ to $C_8$ $\alpha,\beta$-ethylenically unsaturated carboxylic acid copolymer(s) and ionomer(s) thereof, wherein greater than 90%, preferably near 100%, and more preferably 100% of all the acid of (a) and (b) are neutralized.

The thermoplastic composition preferably comprises melt-processible, highly-neutralized (greater than 90%, preferably near 100%, and more preferably 100%) polymer of (1) ethylene, $C_3$ to $C_8$ $\alpha,\beta$-ethylenically unsaturated carboxylic acid copolymers that have their crystallinity disrupted by addition of a softening monomer or other means such as high acid levels, and (2) non-volatile, non-migratory agents such as organic acids (or salts) selected for their ability to substantially or totally suppress any remaining ethylene crystallinity. Agents other than organic acids (or salts) may be used.

It has been found that, by modifying an acid copolymer or ionomer with a sufficient amount of specific organic acids (or salts thereof); it is possible to highly neutralize the acid copolymer without losing processibility or properties such as elongation and toughness. The organic acids employed in the present invention are aliphatic, mono-functional, saturated or unsaturated organic acids, particularly those having fewer than 36 carbon atoms, and particularly those that are non-volatile and non-migratory and exhibit ionic array plasticizing and ethylene crystallinity suppression properties.

With the addition of sufficient organic acid, greater than 90%, nearly 100%, and preferably 100% of the acid moieties in the acid copolymer from which the ionomer is made can be neutralized without losing the processibility and properties of elongation and toughness.

The melt-processible, highly-neutralized acid copolymer ionomer can be produced by the following:

(a) melt-blending (1) ethylene $\alpha,\beta$-ethylenically unsaturated $C_{3-8}$ carboxylic acid copolymer(s) or melt-processible ionomer(s) thereof (ionomers that are not neutralized to the level that they have become intractable, that is not melt-processible) with (1) one or more aliphatic, mono-functional, saturated or unsaturated organic acids having fewer than 36 carbon atoms or salts of the organic acids, and then concurrently or subsequently (b) adding a sufficient amount of a cation source to increase the level of neutralization all the acid moieties (including those in the acid copolymer and in the organic acid) to greater than 90%, preferably near 100%, more preferably to 100%.

Preferably, highly-neutralized thermoplastics of the invention can be made by:

(a) melt-blending (1) ethylene, $\alpha,\beta$-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory agents to substantially remove the remaining ethylene crystallinity, and then concurrently or subsequently (b) adding a sufficient amount of a cation source to increase the level of neutralization all the acid moieties (including those in the acid copolymer and in the organic acid if the non-volatile, non-migratory agent is an organic acid) to greater than 90%, preferably near 100%, more preferably to 100%.

The acid copolymers used in the present invention to make the ionomers are preferably 'direct' acid copolymers. They are preferably alpha olefin, particularly ethylene, $C_{3-8}$ $\alpha,\beta$-ethylenically unsaturated carboxylic acid, particularly acrylic and methacrylic acid, copolymers. They may optionally contain a third softening monomer. By "softening," it is meant that the crystallinity is disrupted (the polymer is made less crystalline). Suitable "softening" co-monomers are monomers selected from alkyl acrylate, and alkyl methacrylate, wherein the alkyl groups have from 1-8 carbon atoms.

The acid copolymers, when the alpha olefin is ethylene, can be described as E/X/Y copolymers where E is ethylene, X is the $\alpha,\beta$-ethylenically unsaturated carboxylic acid, and Y is a softening comonomer. X is preferably present in 3-30 (preferably 4-25, most preferably 5-20) wt. % of the polymer, and Y is preferably present in 0-30 (alternatively 3-25 or 10-23) wt. % of the polymer. Spheres were prepared using fully neutralized ionomers A and B as presented in Table I.

TABLE I

| Sample | Resin Type (%) | Acid Type (%) | Cation (% neut*) | M.I. (g/10 min) |
|---|---|---|---|---|
| 1A | A (60) | Oleic (40) | Mg (100) | 1.0 |
| 2B | A (60) | Oleic (40) | Mg (105)* | 0.9 |

TABLE I-continued

| Sample | Resin Type (%) | Acid Type (%) | Cation (% neut*) | M.I. (g/10 min) |
|---|---|---|---|---|
| 3C | B (60) | Oleic (40) | Mg (100) | 0.9 |
| 4D | B (60) | Oleic (40) | Mg (105)* | 0.9 |
| 5E | B (60) | Stearic (40) | Mg (100) | 0.85 |

A—ethylene, 14.8% normal butyl acrylate, 8.3% acrylic acid
B—ethylene, 14.9% normal butyl acrylate, 10.1% acrylic acid
*indicates that cation was sufficient to neutralize 105% of all the acid in the resin and the organic acid.

These compositions were molded into 1.53-inch spheres for which data is presented in the following table.

TABLE II

| Sample | Atti Compression | COR @ 125 ft/s |
|---|---|---|
| 1A | 75 | 0.826 |
| 2B | 75 | 0.826 |
| 3C | 78 | 0.837 |
| 4D | 76 | 0.837 |
| 5E | 97 | 0.807 |

Further testing of commercially available highly neutralized polymers HNP1 and HNP2 had the following properties.

TABLE III

| Material Properties | HNP1 | HNP2 |
|---|---|---|
| Specific Gravity (g/cm$^3$) | 0.966 | 0.974 |
| Melt Flow, 190° C., 10-kg load | 0.65 | 1.0 |
| Shore D Flex Bar (40 hr) | 47.0 | 46.0 |
| Shore D Flex Bar (2 week) | 51.0 | 48.0 |
| Flex Modulus, psi (40 hr) | 25,800 | 16,100 |
| Flex Modulus, psi (2 week) | 39,900 | 21,000 |
| DSC Melting Point (° C.) | 61.0 | 61/101 |
| Moisture (ppm) | 1500 | 4500 |
| Weight % Mg | 2.65 | 2.96 |

TABLE IV

| Solid Sphere Data | | | | | |
|---|---|---|---|---|---|
| Material | HNP1 | HNP2 | HNP2a | HNP1a | HNP1a/HNP2a (50:50 blend) |
| Spec. Grav. (g/cm$^3$) | 0.954 | 0.959 | 1.153 | 1.146 | 1.148 |
| Filler | None | None | Tungsten | Tungsten | Tungsten |
| Compression | 107 | 83 | 86 | 62 | 72 |
| COR | 0.827 | 0.853 | 0.844 | 0.806 | 0.822 |
| Shore D | 51 | 47 | 49 | 42 | 45 |
| Shore C | | | 79 | 72 | 75 |

These materials are exemplary examples of the preferred center and/or core layer compositions of the present invention. They may also be used as a cover layer herein.

Golf balls made with such cores enjoy high COR at relatively low club speeds. The COR of these balls is higher than the COR of similar balls with higher compression cores at relatively low club speeds. At higher club speeds, however, the COR of golf balls with low compression cores can be lower than the COR of balls with higher compression cores. As illustrated herein, a first golf ball with a 1.505-inch core and a core compression of 48 (hereinafter "Sample-48") and a second golf ball with a 1.515-inch core and a core compression of 80 (hereinafter "Sample-80") were subject to the following distance and COR tests. Sample-48 and Sample-80 have essentially the same size core and similar dual-layer cover. The single most significant difference between these two balls is the compression of the respective cores.

TABLE V

| | | Ball Speed (ft/s) | | | |
|---|---|---|---|---|---|
| | Compression On Ball | Average Driver Set-up | Standard Driver Set-up | Pro 167 Driver Set-up | Big Pro 175 Driver Set-up |
| Sample-48 | 86 | 141.7 | 162.3 | 167.0 | 175.2 |
| Sample-80 | 103 | 141.5 | 162.1 | 168.9 | 176.5 |

| | | Coefficient of Restitution (COR) | | | |
|---|---|---|---|---|---|
| | Compression On Ball | Mass Plate (125 ft/s) | Mass Plate (160 ft/s) | 200-gram Solid Plate (160 ft/s) | 199.8-gram Calibration Plate (160 ft/s) |
| Sample-48 | 86 | 0.812 | 0.764 | 0.759 | 0.818 |
| Sample-80 | 103 | 0.796 | 0.759 | 0.753 | 0.836 |
| Difference (Sample-48-Sample-80) | | +0.016 | +0.005 | +0.006 | −0.018 |

As used in the ball speed test, the "average driver set-up" refers to a set of launch conditions, i.e., at a club head speed to which a mechanical golf club has been adjusted so as to generate a ball speed of about 140 ft/s. Similarly, the "standard driver set-up" refers to similar ball speed at launch conditions of about 160 ft/s; the "Pro 167 set-up" refers to a ball speed at launch conditions of about 167 ft/s; and the "Big Pro 175 set-up" refers to a ball speed at launch conditions of about 175 ft/s. Also, as used in the COR test, the mass plate is a 45-kilogram plate (100 lbs) against which the balls strike at the indicated speed. The 200-gram solid plate is a smaller mass that the balls strike and resembles the mass of a club head. The 199.8-gram calibration plate resembles a driver with a flexible face that has a COR of 0.830.

The ball speed test results show that while Sample-48 holds a ball speed advantage at club speeds of 140 ft/s to 160 ft/s launch conditions, Sample-80 decidedly has better ball speed at 167 ft/s and 175 ft/s launch conditions.

Similarly, the COR test results show that at the higher collision speed (160 ft/s), the COR generally goes down for both balls, but the 199.8-gram calibration test shows that the COR of the higher compression Sample-80 is significantly better than the lower compression Sample-48 at the collision speed (160 ft/s). Additionally, while the COR generally goes down for both balls, the rate of decrease is much less for Sample-80 than for Sample-48. Unless specifically noted, COR values used hereafter are measured by either the mass plate method or the 200-gram solid plate method, i.e., where the impact plate is not flexible. Unless otherwise noted, COR values used hereafter are measured by either the mass plate method or the 200-gram solid plate method.

The intermediate layers of the present invention may, optionally, comprise a durable, low deformation material such as metal, rigid plastics, or polymers re-enforced with high strength organic or inorganic fillers or fibers, or blends or composites thereof, as discussed below. Suitable plastics or polymers include, but not limited to, high cis- or trans-polybutadiene, one or more of partially or fully neutralized ionomers including those neutralized by a metal ion source wherein the metal ion is the salt of an organic acid, polyolefins including polyethylene, polypropylene, polybutylene and copolymers thereof including polyethylene acrylic acid or methacrylic acid copolymers, or a terpolymer of ethylene, a softening acrylate class ester such as methyl acrylate, n-butyl-acrylate or iso-butyl-acrylate, and a carboxylic acid such as acrylic acid or methacrylic acid (e.g., terpolymers including polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates). Suitable polymers also include metallocene catalyzed polyolefins, polyesters, polyamides, non-ionomeric thermoplastic elastomers, copolyether-esters, copolyether-amides, EPR, EPDM, thermoplastic or thermosetting polyurethanes, polyureas, polyurethane ionomers, epoxies, polycarbonates, polybutadiene, polyisoprene, and blends thereof. In the case of metallocenes, the polymer may be cross-linked with a free radical source, such as peroxide, or by high radiation. Suitable polymeric materials also include those listed in U.S. Pat. Nos. 6,187,864; 6,232,400; 6,245,862; 6,290,611; 6,142,887; 5,902,855; and 5,306,760 and in PCT Publication Nos. WO 01/29129 and WO 00/23519.

Preferably, when the intermediate layer is made with polybutadiene or other synthetic and natural rubber, the rubber composition is highly cross-linked with at least 50 phr of a suitable co-reaction agent, which includes a metal salt of diacrylate, dimethacrylate or mono methacrylate. Preferably, the co-reaction agent is zinc diacrylate. Highly cross-linked rubber compounds are discussed in commonly owned co-pending patent application entitled "Golf Ball and Method for Controlling the Spin Rate of Same" bearing application Ser. No. 10/178,580 filed on Jul. 20, 2002. This discussion is incorporated herein by reference.

If desired, the golf ball can include highly rigid materials, such as certain metals, which include, but are not limited to, tungsten, steel, titanium, chromium, nickel, copper, aluminum, zinc, magnesium, lead, tin, iron, molybdenum and alloys thereof. Suitable highly rigid materials include those listed in U.S. Pat. No. 6,244,977. Fillers with very high specific gravity such as those disclosed in U.S. Pat. No. 6,287,217 can also be incorporated into the inner core. Suitable fillers and composites include, but not limited to, carbon including graphite, glass, aramid, polyester, polyethylene, polypropylene, silicon carbide, boron carbide, natural or synthetic silk.

In accordance to one embodiment of the present invention, the golf ball comprises at least two core layers, an innermost core and an outer core, and a cover. Preferably, outer core comprises a flexible, low compression, high COR rubber composition discussed above, and inner core comprises a low deformation material discussed above. The hard, low deformation inner core resists deformation at high club speeds to maintain the COR at an optimal level, while the resilient outer layer provides high COR at slower club speeds and the requisite softness for short iron club play. The inventive ball, therefore, enjoys high initial velocity and high COR at high and low club head speeds associated, while maintaining a desirable soft feel and soft sound for greenside play.

Other rubber compounds for outer core may also include any low compression, highly resilient polymers comprising natural rubbers, including cis-polyisoprene, trans-polyisoprene or balata, synthetic rubbers including 1,2-polybutadiene, cis-polybutadiene, trans-polybutadiene, polychloroprene, poly(norbornene), polyoctenamer and polypentenamer among other diene polymers. Outer core may comprise a plurality of layers, e.g., a laminate, where several thin flexible layers are plied or otherwise adhered together.

Preferably, the rigid inner core, if present, has a flexural modulus in the range of about 25,000 psi to about 250,000 psi. More preferably, the flexural modulus of the rigid inner core is in the range of about 75,000 psi to about 225,000 psi, and most preferably in the range of about 80,000 psi to about 200,000 psi. Furthermore, the rigid inner core has durometer hardness in the range of greater than about 70 on the Shore C scale. The compression of the rigid inner core is preferably in the range of greater than about 60 PGA or Atti. More preferably, the compression is greater than about 70, and most preferably greater than about 80. Shore hardness is measured according to ASTM D-2240-00, and flexural modulus is measured in accordance to ASTM D6272-98 about two weeks after the test specimen are prepared.

Preferably, the outer core is softer and has a lower compression than the inner core. Preferably, outer core has a flexural modulus of about 500 psi to about 25,000 psi. More preferably, the flexural modulus is less than about 15,000 psi. The outer core preferably has a hardness of about 25 to about 70 on the Shore C scale. More preferably, the hardness is less than 60 on the Shore C scale.

One preferred way to achieve the difference in hardness between the inner core and the outer core is to make the inner core from un-foamed polymer, and to make the outer core from foamed polymer selected from the suitable materials disclosed herein. Alternatively, the outer core may be made from these suitable materials having their specific gravity reduced. In this embodiment the inner and outer core can be made from the same polymer or polymeric composition.

Preferably, outer core layer has a thickness from about 0.001 inches to about 0.100 inches, preferably from bout 0.010 inches to about 0.050 inches and more preferably from about 0.015 inches to about 0.035 inches. Preferably, the overall core diameter is greater than about 1.50 inches, preferably greater than about 1.580 inches, and more preferably greater than about 1.60 inches. The inner core may have any dimension so long as the overall core diameter has the preferred dimensions listed above.

The cover should be tough, cut-resistant, and selected from conventional materials used as golf ball covers based on the desired performance characteristics. The cover may be comprised of one or more layers. Cover materials such as ionomer resins, blends of ionomer resins, thermoplastic or thermoset urethane, and balata, can be used as known in the art.

The cover is preferably a resilient, non-reduced specific gravity layer. Suitable materials include any material that allows for tailoring of ball compression, coefficient of restitution, spin rate, etc. and are disclosed in U.S. Pat. Nos. 6,419,535; 6,152,834; 5,919,100; and 5,885,172. Ionomers, ionomer blends, thermosetting or thermoplastic polyurethanes, metallocenes, polyurethanes, polyureas (and hybrids thereof), are the preferred materials. The cover can be manufactured by a casting method, reaction injection molded, injected or compression molded, sprayed or dipped method. Preferably the cover is cast about the core.

In a preferred embodiment, the golf ball includes an intermediate layer, as either an outer core layer or an inner cover, in addition to the outer cover. As disclosed in the U.S. Pat. Nos. 5,885,172 and 6,132,324, which are incorporated herein by reference in their entireties, outer cover layer is made from a soft thermoset material, such as cast polyurethane or polyurea, and inner cover is made from an ionomeric material, preferably including at least two ionomers.

When the intermediate layer is an inner cover layer, it is preferably formed from a high flexural modulus material which contributes to the low spin, distance characteristics of the presently claimed balls when they are struck for long shots (e.g. driver or long irons). Specifically, the inner cover layer materials have a Shore D hardness of about 55 or greater, preferably about 55-70 and most preferably about 60-70. The flexural modulus of intermediate cover layer is at least about 50,000 psi, preferably about 50,000 psi to about 150,000 psi and most preferably about 75,000 psi to about 125,000 psi. In the preferred embodiment, the intermediate layer has a thickness of from about 0.1 inches to about 0.5 inches, more preferably between about 0.11 inches and about 0.12 inches, and most preferably between about 0.115 inches and about 0.119 inches. In another thin-layer embodiment, he thickness of the intermediate layer can range from about 0.020 inches to about 0.045 inches, preferably about 0.030 inches to about 0.040 inches and most preferably about 0.035 inches.

Outer cover layer is formed preferably from a relatively soft thermoset material in order to replicate the soft feel and high spin play characteristics of a balata ball for "short game" shots. In particular, the outer cover layer should have Shore D hardness of less than 65 or from about 40 to about 64, preferably 40-60 and most preferably 40-50. Additionally, the materials of the outer cover layer must have a degree of abrasion resistance in order to be suitable for use as a golf ball cover. The outer cover layer of the present invention can comprise any suitable thermoset or thermoplastic material, preferably which is formed from a castable reactive liquid material. The preferred materials for the outer cover layer include, but are not limited to, thermoset urethanes and polyurethanes, thermoset urethane ionomers and thermoset urethane epoxies. Examples of suitable polyurethane ionomers are disclosed in U.S. Pat. No. 5,692,974 entitled "Golf Ball Covers," the disclosure of which is hereby incorporated by reference in its entirety in the present application. Thermoset polyurethanes and polyureas are preferred for the outer cover layers of the balls of the present invention.

In accordance with another embodiment of the present invention, the golf ball comprises a relatively small, low compression, high COR inner core. The diameter of the inner core (or center) is preferably less than 1.40 inches or smaller, more preferably 0.8 inches to about 1.4 inches, and most preferably from about 1.3 inches to about 1.4 inches. The desired thickness of either the core (center) or intermediate layer can be selected in conjunction with the flexural modulus of the material of the layers and the desired overall compression of the ball and deformation of the ball.

Most preferably, inner core is formed from a rubber composition containing a halogenated thiophenol compound. Such halogenated thiophenol compounds are fully disclosed in commonly owned and co-pending '963 and '448 patent applications, which have already incorporated by reference and discussed above. In accordance to one aspect of the second embodiment, the rubber compound preferably is a high cis- or trans-polybutadiene and has a viscosity of about 40 Mooney to about 60 Mooney. The core has a hardness of greater than about 70 on the Shore C scale, and preferably greater than 80 on the Shore C scale. The core also has a compression of less than about 60 PGA, and more preferably less than about 50 PGA. The resulting core exhibits a COR of at least about 0.790, and most preferably at least 0.800 at 125 ft/s. Other suitable polymers for inner core include a polyethylene copolymer, EPR, EPDM, a metallocene catalyzed polymer or any of the materials discussed above in connection with outer core discussed above, so long as the preferred compression, hardness and COR are met.

Inner core may be encased by outer core layers comprising the same materials or different compositions than inner core. These outer core layers may be laminated together. Each of the laminate layers preferably has a thickness from about 0.001 inches to about 0.100 inches and more preferably from about 0.010 inches to about 0.050 inches.

Preferably, the intermediate layer is made from a low deformation polymeric material, such as an ionomer, including low and high acid ionomer, any partially or fully neutralized ionomer or any thermoplastic or thermosetting polymer. The intermediate layer preferably has a flexural modulus of greater than 50,000 psi and more preferably greater than 75,000 psi. Among the preferred materials are hard, high flexural modulus ionomer resins and blends thereof. Additionally, other suitable mantle materials (as well as core and cover materials) are disclosed in U.S. Pat. No. 5,919,100 and international publications WO 00/23519 and WO 01/29129. These disclosures are incorporated by reference herein in their entireties. One particularly suitable material disclosed in WO 01/29129 is a melt processible composition comprising a highly neutralized ethylene copolymer and one or more aliphatic, mono-functional organic acids having fewer than 36 carbon atoms of salts thereof, wherein greater than 90% of all the acid of the ethylene copolymer is neutralized.

These ionomers are obtained by providing a cross metallic bond to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0-50 weight percent of the polymer (preferably 0-25 wt. %, most preferably 0-20 wt. %), and Y is acrylic or methacrylic acid present in 5-35 weight percent of the polymer (preferably at least about 16 wt. %, more preferably at least about 16-35 16 wt. %, most preferably at least about 16-20 16 wt. %), wherein the acid moiety is neutralized 1-90% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art as described in e.g., U.S. Pat. No. 3,262,272. Such ionomer resins are commercially available from DuPont under the tradename SURLYN® and from Exxon under the tradename IOTEK®. Some particularly suitable SURLYNS® include SURLYN® 8140 (Na) and SURLYN® 8546 (Li), which have a methacrylic acid content of about 19%.

Other suitable mantle materials include the low deformation materials described above and any hard, high flexural modulus, resilient material that is compatible with the other materials of the golf ball. Examples of other suitable inner cover materials include thermoplastic or thermoset polyurethanes, thermoplastic or thermoset polyetheresters or polyetheramides, thermoplastic or thermoset polyester, a dynamically vulcanized elastomer, a functionalized styrenebutadiene elastomer, a metallocene polymer or blends thereof.

Suitable thermoplastic polyetheresters include materials, which are commercially available from DuPont under the tradename HYTREL®. Suitable thermoplastic polyetheramides include materials, which are available from Elf-Atochem under the tradename PEBAX®. Other suitable materials for the inner cover layer include nylon and acrylonitrile-butadiene-styrene copolymer (ABS).

Another suitable material for the intermediate layer is a high stiffness, highly neutralized ionomer having a durometer hardness of at least about 50 on the Shore D scale and a flexural modulus of at least 50,000 psi. The flexural modulus ranges from about 50,000 psi to about 150,000 psi. The hardness ranges from about 55 to about 80 Shore D, more preferably about 55 to about 70 Shore D. This ionomer, preferably at least two ionomers, may be blended with a lowly neutralized ionomers having an acid content of 5 to 25%, and may be blended with non-ionomeric polymers or compatilizers (e.g., glycidyl or maleic anhydride), so long as the preferred hardness and flexural modulus are satisfied. Examples of highly neutralized ionomers are disclosed in U.S. Pat. No. 6,756,436 which is incorporated herein by reference.

In one preferred embodiment, this suitable material is a blend of a fatty acid salt highly neutralized polymer, such as a melt processible composition comprising a highly neutralized ethylene copolymer and one or more aliphatic, monofunctional organic acids having fewer than 36 carbon atoms of salts thereof, wherein greater than 90% of all the acid of the ethylene copolymer is neutralized, and a high stiffness partially neutralized ionomer, such as those commercially available as SURLYN® 8945, 7940, 8140 and 9120, among others. This blend has hardness in the range of about 65 to about 75 on the Shore D scale.

The intermediate layer may also comprise a laminated layer, if desired. For example, the intermediate layer may comprise a laminate comprising four layers: a polyamide layer having a flexural modulus of about 200,000 psi, a terpolymer ionomer or un-neutralized acid terpolymer having a flexural modulus of about 30,000 psi, a low acid ionomer having a flexural modulus of about 60,000 psi and a high acid ionomer having a flexural modulus of about 70,000 psi. The composite flexural modulus of the four-layer laminate is about 90,000 psi or approximately the average of the flexural modulus of the four layers, assuming that the thickness of each layer is about the same.

In a preferred embodiment, inner core, if present, has a diameter of about 0.800 to about 1.400 inches, more preferably about 1.3 to about 1.4 inches, a compression of about 44 or less, and a COR of about 0.800. The intermediate layer comprises at least two ionomers having a flexural modulus of about 50,000 psi or higher and has a thickness of at least about 0.110 inches, preferably between about 0.11 inches and about 0.12 inches. The cover is preferably a cast polyurethane or polyurea having a hardness of about 40 to about 60 Shore D. The core compression is preferably about 44 or less, and the combination of core and intermediate layer has a compression of from about 70 to about 100.

The core preferably comprises a single solid layer. Alternatively, the core may comprise multiple layers. Preferably, its diameter is about 1.400 inches or less, more preferably between about 0.8 inches and about 1.4 inches, most preferably between about 1.3 inches and about 1.4 inches. The core has a COR of about 0.770 or greater, more preferably about 0.800 or greater, and most preferably about 0.820 or greater, so as to give the ball a COR of at least 0.800 and more preferably in the range of about 0.805 to about 0.820. In one preferred embodiment, the core has a COR of about 0.770 to about 0.810.

In a preferred embodiment, intermediate cover layer and outer cover layer are similar to the inner cover layer and the outer cover layer of cover, respectively, for progressive performance. For example, outer cover layer is made from a soft, thermosetting polymer, such as cast polyurethane, and intermediate cover layer is made from a rigid ionomer or similar composition having hardness of at least 55 on the Shore D scale and flexural modulus of at least 55,000 psi.

The total thickness the cover is preferably less than 0.125 inches. Innermost layer preferably is about 0.005 inches to about 0.100 inches thick, more preferably 0.010 inches to about 0.090 inches, and most preferably about 0.015 inches to about 0.070 inches. Intermediate cover layer preferably is about 0.010 inches to about 0.050 inches thick, and outer cover layer preferably is about 0.020 inches to about 0.040 inches thick.

Golf balls made in accordance to the present invention and disclosed above have a compression of greater than about 60 PGA, more preferably greater than about 80 and even more preferably greater than about 90 PGA. These balls exhibit COR of at least 0.80 at 125 ft/s and more preferably at least 0.81 at 125 ft/s. These balls also exhibit COR of at least 0.75 at 160 ft/s and more preferably at least 0.76 at 160 ft/s.

All patents and patent applications cited in the foregoing text are expressly incorporated herein by reference in their entirety.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising:

a core having a compression of 50 or less and a coefficient of restitution of 0.800 or greater;

an outer cover comprising a crosslinked diene rubber composition, the cover having a hardness of 64 Shore D or less and a thickness of 0.02 inches to 0.1 inches; and an intermediate layer disposed between the core and the cover, the intermediate layer having a thickness of 0.11 inches or greater and comprising a partially- or fully-neutralized ionomer;

wherein the crosslinked diene rubber composition comprises a polybutadiene rubber having a cis-structure of at least 95%, a molecular weight of greater than about 400,000, a Mooney viscosity of greater than 50, and a polydispersity of no greater than about 2, and a combination of the core and the intermediate layer has a compression of about 60 or greater and the golf ball has a coefficient of restitution of 0.805 or greater when measured at an incoming velocity of 125 ft/s and greater than 0.75 when measured at an incoming velocity of 160 ft/s.

2. The golf ball of claim 1, wherein the combination of the core and the intermediate layer has a compression of 70 to 100, and the golf ball has a coefficient of restitution of 0.805 to 0.820 when measured at an incoming velocity of 125 ft/s and a compression of 75 to 105.

3. The golf ball of claim 1, wherein the golf ball has a compression of 80 or greater.

4. The golf ball of claim 3, wherein the golf ball has a compression of 90 or greater.

5. The golf ball of claim 1, wherein the core has a diameter of 0.5 inches to 1.4 inches and a compression of 45 or less; and the intermediate layer has a flexural modulus of 50,000 psi to 150,000 psi and a thickness of 0.12 inches or greater.

6. The golf ball of claim 1, wherein the core comprises a center and at least one outer core layer.

7. The golf ball of claim 1, wherein the core has a diameter of 0.8 inches to 1.3 inches and the intermediate layer has a flexural modulus of 50,000 psi to 150,000 psi and a thickness of 0.17 inches or greater.

8. The golf ball of claim 1, wherein the golf ball further comprises an inner cover layer disposed between the outer cover layer and the intermediate layer.

9. The golf ball of claim 1, wherein the intermediate layer has a hardness of 55 Shore D to 70 Shore D.

10. The golf ball of claim 1, wherein a combination of the intermediate layer and the core has a coefficient of restitution of 0.810 to 0.820 when measured at an incoming velocity of 125 ft/s.

11. A golf ball comprising:

a core having a compression of 50 or less and a coefficient of restitution of 0.800 or greater;

an outer cover comprising a crosslinked diene rubber composition, the cover having a hardness of 64 Shore D or less and a thickness of 0.02 inches to 0.1 inches; and an intermediate layer disposed between the core and the cover, the intermediate layer having a thickness of 0.11 inches or greater and comprising a fully-neutralized thermoplastic material comprising a highly-neutralized thermoplastic material comprising an ethylene, α,β-ethylenically unsaturated $C_{3-8}$ carboxylic acid copolymer(s), a fatty acid salt, and a sufficient amount of a cation source to increase the level of neutralization of all the acid moieties to 100%;

wherein the crosslinked diene rubber composition comprises a polybutadiene rubber having a cis-structure of at least 95%, a molecular weight of greater than about 400,000, a Mooney viscosity of greater than 50, and a polydispersity of no greater than about 2, and a combination of the core and the intermediate layer has a compression of 60 or greater and the golf ball has a coefficient of restitution of 0.805 or greater when measured at an incoming velocity of 125 ft/s and greater than 0.75 when measured at an incoming velocity of 160 ft/s.

12. The golf ball of claim 11, wherein the core has a diameter of 0.5 inches to 1.4 inches and a compression of 45 or less; and the intermediate layer has a flexural modulus of 50,000 psi to 150,000 psi and a thickness of about 0.12 inches or greater.

13. The golf ball of claim 11, wherein the core has a diameter of 0.8 inches to 1.4 inches.

14. The golf ball of claim 11, wherein the core comprises a center and at least one outer core layer.

15. The golf ball of claim 11, wherein a combination of the core and the intermediate layer has a compression of 70 to 100, and the golf ball has a coefficient of restitution of 0.805 to 0.820 when measured at an incoming velocity of 125 ft/s and a compression of 75 to 105.

16. The golf ball of claim 11, wherein the golf ball has a compression of 80 or greater.

17. The golf ball of claim 16, wherein the golf ball has a compression of 90 or greater.

18. The golf ball of claim 11, wherein the core has a diameter of 0.8 inches to 1.3 inches and the intermediate layer has a flexural modulus of 50,000 psi to 150,000 psi and a thickness of 0.17 inches or greater.

19. The golf ball of claim 11, wherein the golf ball further comprises an inner cover layer disposed between the outer cover layer and the intermediate layer.

20. The golf ball of claim 11, wherein the intermediate layer has a hardness of 55 Shore D to 70 Shore D.

* * * * *